United States Patent [19]

Laakso

[11] 4,002,528

[45] Jan. 11, 1977

[54] APPARATUS FOR PROCESSING PULP

[75] Inventor: Oliver A. Laakso, Glens Falls, N.Y.

[73] Assignee: Kamyr, Inc., Glens Falls, N.Y.

[22] Filed: Dec. 15, 1975

[21] Appl. No.: 640,926

Related U.S. Application Data

[63] Continuation of Ser. No. 227,438, Feb. 18, 1972, abandoned.

[52] U.S. Cl. ..... 162/237; 162/19; 162/28; 162/242

[51] Int. Cl.[2] ..... D21C 7/00

[58] Field of Search ..... 162/234, 237, 242, 19, 162/28, 55

[56] References Cited

UNITED STATES PATENTS

| | | | |
|---|---|---|---|
| 2,360,779 | 10/1944 | Lang et al. | 162/55 |
| 2,847,304 | 8/1958 | Rasch et al. | 162/55 X |
| 2,913,362 | 11/1959 | Cusi | 162/55 |
| 2,947,655 | 8/1960 | Eberhardt | 162/28 X |
| 3,200,032 | 8/1965 | Richter et al. | 162/19 |
| 3,427,218 | 2/1969 | Richter | 162/19 |
| 3,446,699 | 5/1969 | Asplund et al. | 162/19 |

*Primary Examiner*—Robert L. Lindsay, Jr.
*Assistant Examiner*—George C. Yeung
*Attorney, Agent, or Firm*—Cushman, Darby & Cushman

[57] ABSTRACT

Apparatus for refining digested pulp involving the use of a refiner, preferably two or more refiners in series positioned in the digester blow line to receive washed, digested pulp discharged from a continuous digester.

2 Claims, 3 Drawing Figures

Fig. 1
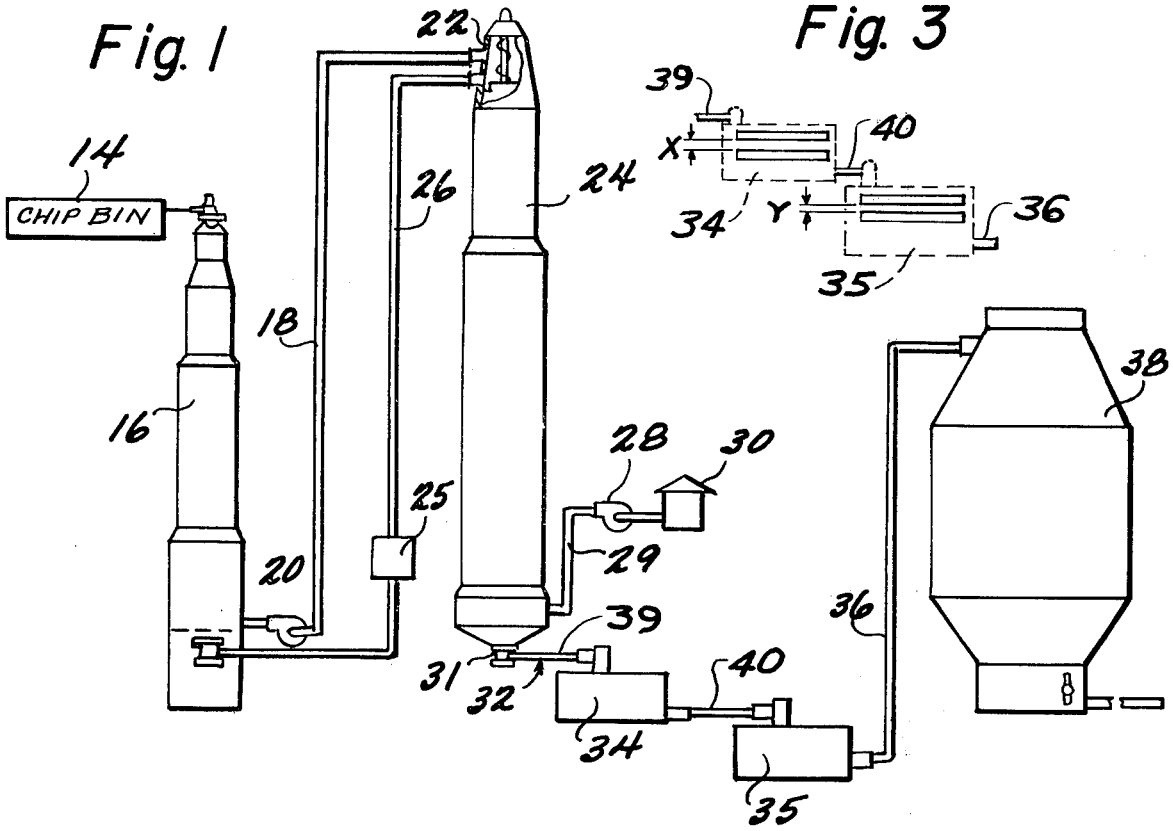
Fig. 3
Fig. 2
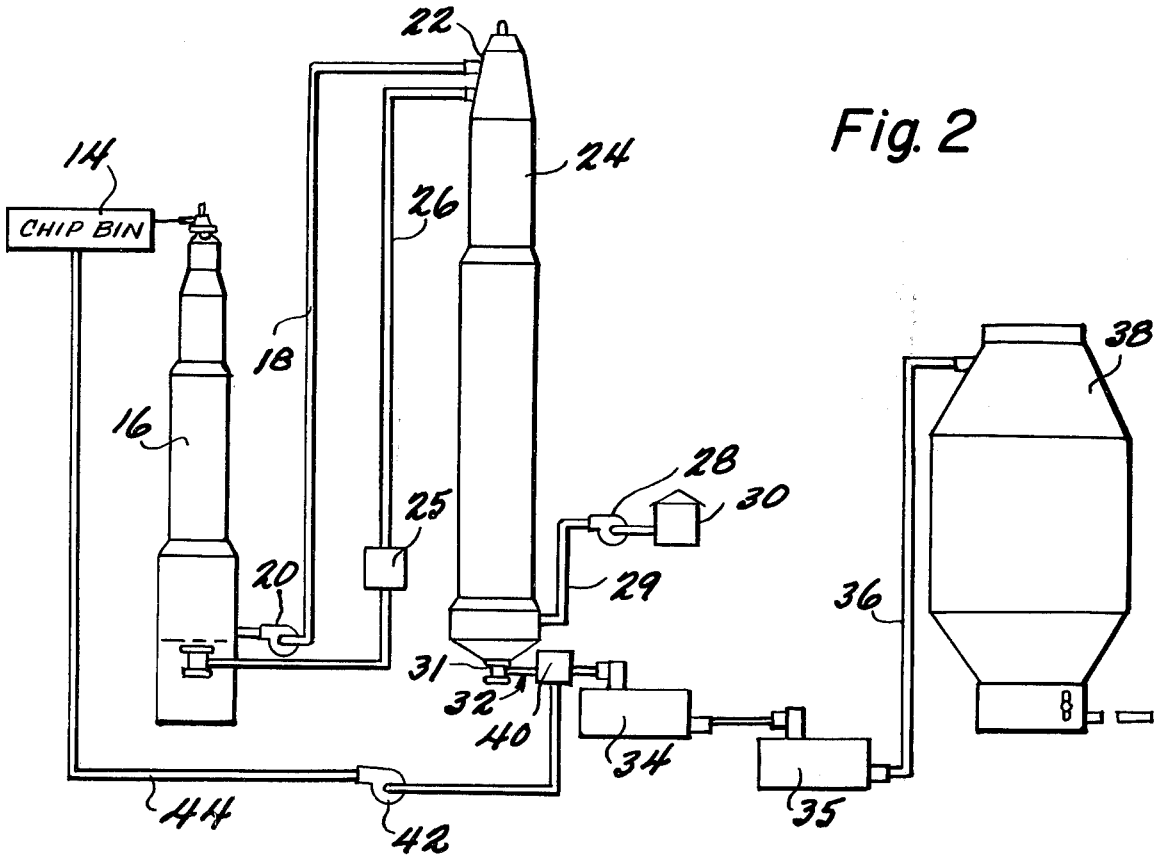

APPARATUS FOR PROCESSING PULP

This is a continuation, of application Ser. No. 227,438 filed Feb. 18, 1972, now abandoned.

BACKGROUND AND SUMMARY OF THE INVENTION

The present invention is concerned with a novel apparatus for refining digested cellulosic pulp.

In pulp processing systems, it is conventional to subject the digested pulp, after dilution with water, to certain screening and refining operations for the purpose of removing undesired coarse or non-digested materials. For example, a continuous digester, although relatively efficient, does not normally reduce 100% of the woodchips entering the digester so as to completely delignify the fibres. Consequently the pulp as discharged from the digester may contain up to 1% of undigested knots and possibly an additional 1% of small matchstick-like undigested particles generally known as "shives". Before being converted to bleached pulp or unbleached papers, it becomes necessary to remove this small percentage of coarse material from the pulp stock. In conventional operations, this is done in a screen room and, as a part of conventional screen room processing, it is necessary to dilute the stock from its normal 10 to 15% by weight consistency as discharged from the digester, to a consistency in the range of 2 to 4%. At these low consistencies, the stock is sufficiently diluted that it is possible to remove the knots and shives from the pulp stock by the use of various screening apparatus after which the pulp is then again rethickened by means of deckers to consistencies in the range of 8 to 15% for storage and subsequent processing, either as unbleached or bleached pulp. Thus, in essence, the operation taking place in the screen room consists of separating the coarse material from the completely defibred pulp. The separated coarse material is then rethickened and refined so as to defibre it and it is then returned again to the beginning of the screening system for further processing while the screened pulp is thickened for storage or other processing or handling. In some cases knots may be handled separately and returned to the digester system.

The screening operation is generally a wasteful one in that it requires the use of large quantities of water and electric power and much machinery to dilute the digested pulp, remove the small percentage of coarse material from the diluted pulp and then to thicken the screened pulp for storage and the separated coarse material for refining and return to the beginning of the screening system. Thus, as an example, a screen room for a 500 to 1000 ton-per-day mill may cost in the vicinity of two to three million dollars.

The present invention is based on the finding that the extensive screen room operations of conventional pulp processing systems can be eliminated or substantially reduced by placing two or more refiners in series at some convenient point in the blow line (i.e., the discharge line) of a continuous digester in which the washing system is integral with the digester so that washed pulp, essentially free from digesting liquor (alkali) can be discharged directly from the digester into the blow line. The pulp, as discharged from the digester into the blow line in a continuous digester of this type, is under relatively high pressure (e.g. 10–20 atmospheres) and in the complete absence of air at high consistency (e.g. 6–15% solids). The invention is based on the finding that this washed, digested material can be fed directly into two or more refiners placed in series in the digester blow line to refine the stock with great efficiency to reduce shives and other coarse material to fibers, without the need for diluting the stock, screening and refining as in conventional operations. The resultant saving, in terms of equipment, water and power, is immediately evident.

Numerous tupes of pulp refiners are known in the art and any of these may be used for present purposes. Broadly speaking, such refiners constitute a grinding apparatus which includes a rotary grinding disc which has an active face opposed by and spaced from a stationary grinding surface. The digested pulp is introduced into the refiner and, as known, passes between the grinding surfaces where mechanical action causes the coarse material therein, e.g. shives, to be sheared into fibers.

For present purposes, it is preferable to arrange the refiners in series so that the first one is a coarse refiner, i.e., the grinding surfaces are relatively widely spaced from each other to give a coarse degree of refining, and the second refiner is a fine refiner where the grinding surfaces are quite close together to complete the refining operation. The grinding surfaces of the first refiners are spaced a distance X from each other, and the grinding surfaces of the second refiner are spaced a distance Y from each other wherein Y is substantially less than X. In some cases it is possible to effectively use only a single refiner in the blow line but where relatively hard pulp stock, i.e., only partially digested stock, is involved, two or more refiners in series are essential for blow line refining.

The duration of the refining operation will vary depending on other factors, e.g. the rate of pulp fed thereto and the degree of refinement desired. It will be appreciated, however, that the timing and other conditions of the operation are such that the pulp moves continuously as a compact, essentially air-free mass or column of digested material from the digester and digester blow line into and through the refiners to the pulp storage tank or other processing or handling phase. The pressure on the pulp in the refiners will vary depending, for example, on their position in the blow line. For example, the pulp pressure may be in the order of 10–20 atmospheres at or near the discharge from the digester and more like 5–10 atmospheres, or even somewhat less further along the blow line towards the pulp storage tank into which the blow line normally discharges.

BRIEF DESCRIPTION OF THE DRAWINGS

The invention will be more fully understood by reference to the accompanying drawings wherein FIGS. 1 and 2 are diagrammatic views of pulp processing systems embodying the invention. FIG. 3 is a diagrammatic showing of the grinding surface spacings of exemplary refiners utilized in the systems according to the present invention.

DETAILED DESCRIPTION OF THE INVENTION

As shown in FIG. 1, wood chips are introduced from a chip bin 14 to a preliminary steaming vessel 16 in which the chips are softened by exposure to low pressure, high temperature steam. From the steaming vessel 16, the chips are transported through the conduit 18 by a circulating pump 20 to a separator 22 at the top of a continuous digester 24. In the separator the chips are separated from water which is then recycled by line 26 to the vessel 16 via a heater 25 where the water is heated to the desired temperature.

The chips pass through the digester under the influence of gravity and pressure and are thoroughly exposed to alkali digesting liquor as well known in the art.

In the bottom section of the digester the chips are washed by means of hot water from a supply 30 introduced by suitable pump means 28 and conduit 29 for the purpose of removing essentially all of the alkali digesting liquor therefrom. The amount of alkali in the washed pulp as discharged from the digester should generally not exceed about 0.5% by weight since the presence of any significant amount of alkali in the pulp during the refining operation will damage the fibers.

It is essential for present purposes that the continuous digester 24 be one which discharges essentially air- and alkali-free, relatively highly concentrated (e.g. 6–15% by weight solids) stock at elevated pressure (typically 10–20 atmospheres). Digesters which are suitable for this purpose are described in such U.S. Pat. Nos. as 3,200,032, issued Aug. 10, 1965; 3,413,189, issued Nov. 26, 1968; 3,425,898, issued Feb. 4, 1969; 3,427,218 issued Feb. 11, 1969; and 3,579,420 and 3,579,421, both issued May 18, 1971, the subject matter of these patents being incorporated herein by reference. Continuous digesting sytems suitable for use herein are also described in Bulletin No. 200 F of Kamyr Incorporated entitled "Continuous Cooking Installations". Broadly defined, continuous digesters of the type suitable for use herein comprise a vertical processing member with a top chip inlet section, one or more sections for digesting the chips with alkali and a washing section in the bottom portion thereof. Preferably the digester is one which includes a washing section of the diffusion washing type but, in any event, the digester chosen must be such as to remove essentially all of the alkali used for digesting purposes before discharge into the blow line.

In the embodiment of FIG. 1, the washed pulp is discharged from the digester at 31 into the blow line 32 and then into refiners 34 and 35 arranged in series. Preferably the first refiner 34 is a coarse one while the second refiner is a fine one sufficient to complete the refining. The grinding surfaces of course refiner 34 are spaced a distance X, as shown diagrammatically in FIG. 3, and the grinding surfaces of fine refiner 35 are spaced a distance Y, wherein Y is substantially less than X, as shown diagrammatically in FIG. 3. As noted earlier, the refiners may be of conventional construction (such as shown in U.S. Pat. No. 3,523,649) although it may be necessary, due to the pressure of the pulp at this stage, to use high pressure casings and packing around the refiners in contrast to the usual use of the refiner in connection with conventional screening operations where the pulp is processed at essentially atmospheric pressure. The blow line 32 consists of a means (pipe 39) for connecting the first refiner 34 so that no pressure reduction will occur during transport of digested material to the first refiner 34 other than pressure reductions that necessarily result from the transport of the digested material over a distance, and so that no decrease in solids content occurs, and a means (pipe 40) for connecting the second refiner 35 in series with the first refiner 34 so that no pressure reduction will occur during transport of digested material to the second refiner from the first refiner other than pressure reductions that necessarily result from the transport of the digested material over a distance, and so that no decrease in solids content occurs.

After the refining operation, the refined pulp is fed through line 36, which is essentially an extension of the blow line broken by the refiners, to a pulp storage tank 38 or to other processing or handling operations, e.g. bleaching, or the like. The line 36 provides a means for discharging refined digested material from the second refiner 35 to a subsequent treatment station 38 at a pressure of about 5–10 atmospheres.

Separate pump means (not shown) may be used after the refiner to advance the refined pulp to subsequent stages in the system although the pressure in the digester is usually adequate to accomplish this.

FIG. 2 shows the same system as FIG. 1 except that the system of FIG. 2 includes a pressure deknotter 40 positioned in the blow line 32 just before the first refiner 34. Knots removed by the deknotter 40 may be discharged from the system and/or they may be pumped, as shown in FIG. 2, by means of pump 42 and conduit 44 back to the chip bin 14 for further digesting treatment. Pressure deknotters are known in the art and any such deknotter operable within the pressure indicated may be used for present purposes.

Apart from the advantages indicated earlier herein, a further advantage of the present invention is that, since the refiners are operating under pressure and the system is filled with pulp, the possibility of air pockets, which frequently occur in conventional refining operations, is completely avoided or substantially minimized thereby improving the overall efficiency of the refiner. The pulp moves as an essentially air-free mass of digested material from the digester discharge 31 through the refiners 34, 35 to the subsequent treatment station 38.

As an illustration of specific operations according to the invention using the system illustrated in FIG. 1, wood chips were digested in digester 24 and washed therein as described in the patents referred to above to give an 8% solids pulp at 250 psig pressure and 70° C discharged into the blow line 32 and then into refiners 34 and 35. Pulp was fed continuously through the refiners and then blown into storage tank 38 to give a produce which was essentially shive-free.

Various modifications may be made in the invention as described above. Hence the scope of the invention is defined in the following claims wherein:

I claim:

1. Apparatus for processing pulp comprising a continuous cellulose digester including a discharge and means for washing digested material in said digester before discharge therefrom, means for feeding material to be digested to said digester, a blow line communicating with said digester discharge to receive digested material at a 6–15% solids content and at a pressure of about 10–20 atmospheres, a first refiner for breaking up the solids in said digested material into individual fibers, said refiner including a pair of grinding surfaces that are spaced a distance X from each other, means for connecting said first refiner in said blow line so that no pressure reduction will occur during transport of digested material to said first refiner other than pressure reductions that necessarily result from the transport of the digested material over a distance, and so that no decrease in solids content occurs, a second refiner for breaking up the solids in said digested material into individual fibers, said refiner including a pair of grinding surfaces that are spaced a distance Y from each other, and wherein Y is substantially less than X, means for connecting said second refiner in said blow line in series with said first refiner so that no pressure reduction will occur during transport of digested material to said second refiner from said first refiner other than pressure reductions that necessarily result from the transport of the digested material over a distance, and so that no decrease in solids content occurs, and means for discharging refined digested material from said second refiner to a subsequent treatment station at a pressure of about 5–10 atmospheres, the pulp moving as an essentially air-free mass of digested material from said digester discharge through said refiners to said subsequent treatment station.

2. Apparatus as recited in claim 1 further comprising a deknotter disposed in said blow line between said digester discharge and said first refiner.

* * * * *